US011965680B2

(12) United States Patent
Ogata

(10) Patent No.: US 11,965,680 B2
(45) Date of Patent: Apr. 23, 2024

(54) HEAT PUMP DEVICE

(71) Applicant: Nihon Itomic Co., Ltd., Sumida-ku Tokyo (JP)

(72) Inventor: Masami Ogata, Yawata (JP)

(73) Assignee: Nihon Itomic Co., Ltd., Tokyo (JP)

( * ) Notice: Subject to any disclaimer, the term of this patent is extended or adjusted under 35 U.S.C. 154(b) by 0 days.

(21) Appl. No.: 17/790,105

(22) PCT Filed: Aug. 24, 2021

(86) PCT No.: PCT/JP2021/030887
§ 371 (c)(1),
(2) Date: Jan. 26, 2023

(87) PCT Pub. No.: WO2023/026344
PCT Pub. Date: Mar. 2, 2023

(65) Prior Publication Data

US 2023/0184469 A1 Jun. 15, 2023

(51) Int. Cl.
*F25B 30/02* (2006.01)
*F25B 41/20* (2021.01)
(Continued)

(52) U.S. Cl.
CPC ..... *F25B 30/02* (2013.01); *F25B 41/20* (2021.01); *F25B 41/31* (2021.01); *F25B 41/37* (2021.01);
(Continued)

(58) Field of Classification Search
CPC ..... F25B 2700/2117; F25B 2700/2115; F25B 2600/2515; F25B 41/37; F25B 41/31; F25B 41/20; F25B 30/02
See application file for complete search history.

(56) References Cited

U.S. PATENT DOCUMENTS 4,646,539 A 3/1987 Taylor
2015/0323233 A1* 11/2015 Kerschenbauer ..... F25B 45/00 62/298

FOREIGN PATENT DOCUMENTS

CN 104833013 A 8/2015
CN 105972822 A 9/2016
(Continued)

OTHER PUBLICATIONS

International Application No. PCT/JP2021/030887, International Search Report and Written Opinion dated Oct. 19, 2021, 10 pages.
(Continued)

*Primary Examiner* — Kun Kai Ma

(57) ABSTRACT

In a heat pump device in which a compressor, a gas cooler, a refrigerant heat exchanger, a refrigerant expansion valve, and an evaporator are connected to configure a refrigerant circulation circuit, the heat pump device includes a buffer tank, one end being connected to the high-pressure side of the refrigerant expansion valve and arranged to store a refrigerant, and a first refrigerant pipe, one end being connected to the high-pressure side of the compressor and the other end connected to the low-pressure side of the evaporator and arranged to exchange heat with the buffer tank. The first refrigerant pipe includes a first control valve arranged between the high-pressure side of the compressor and the buffer tank to control opening and closing of the first refrigerant pipe, and a first flow rate regulator arranged between the buffer tank and the low-pressure side of the evaporator to control the refrigerant flow rate.

20 Claims, 4 Drawing Sheets

(51) Int. Cl.
*F25B 41/31* (2021.01)
*F25B 41/37* (2021.01)

(52) U.S. Cl.
CPC ..... *F25B 2600/2515* (2013.01); *F25B 2700/21151* (2013.01); *F25B 2700/2117* (2013.01)

(56) References Cited

FOREIGN PATENT DOCUMENTS

| | | | | | |
|---|---|---|---|---|---|
| CN | 108362038 | A | | 8/2018 | |
| CN | 209214113 | U | | 8/2019 | |
| JP | H09-196480 | A | | 7/1997 | |
| JP | 3602116 | B2 | | 12/2004 | |
| JP | 2007178042 | A | * | 7/2007 | ..... F25B 1/10 |
| JP | 4255416 | B2 | * | 4/2009 | ..... F25B 9/008 |
| KR | 20150033157 | A | * | 4/2015 | |
| WO | WO-2006057111 | A1 | * | 6/2006 | ..... F25B 13/00 |
| WO | WO-2014192138 | A1 | * | 12/2014 | ..... F25B 13/00 |
| WO | WO-2017061009 | A1 | * | 4/2017 | ..... F25B 13/00 |
| WO | 2019026276 | A1 | | 2/2019 | |
| WO | 2019156021 | A1 | | 8/2019 | |

OTHER PUBLICATIONS

Decision to Grant Patent, Japanese Application No. 2021-571496, dated Jan. 25, 2022, 6 pages.

* cited by examiner

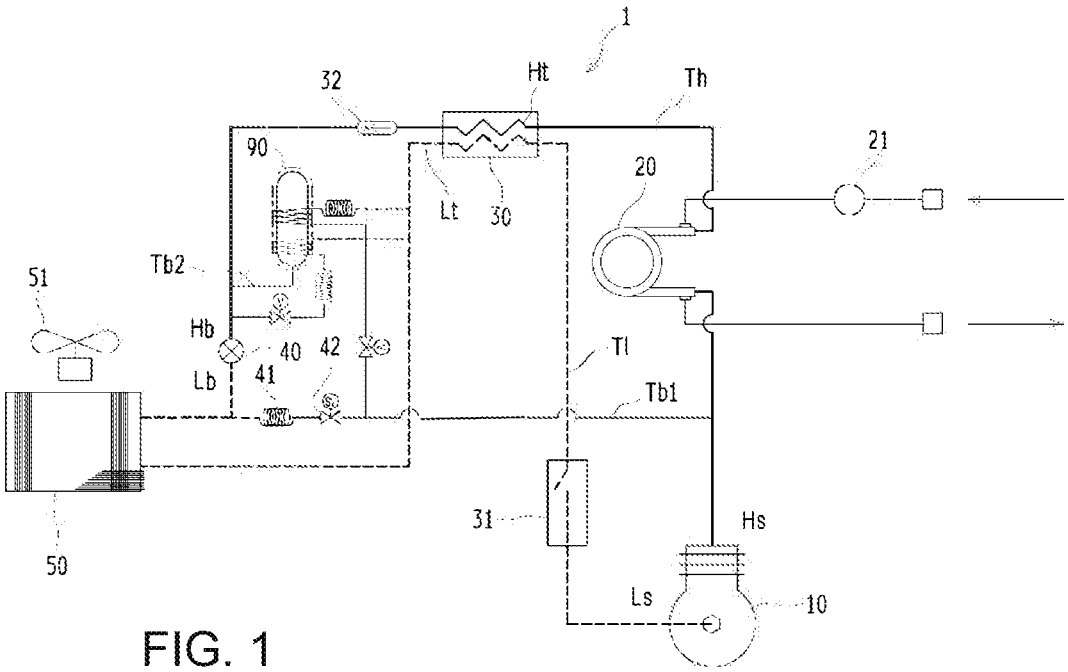
FIG. 1
FIG. 2
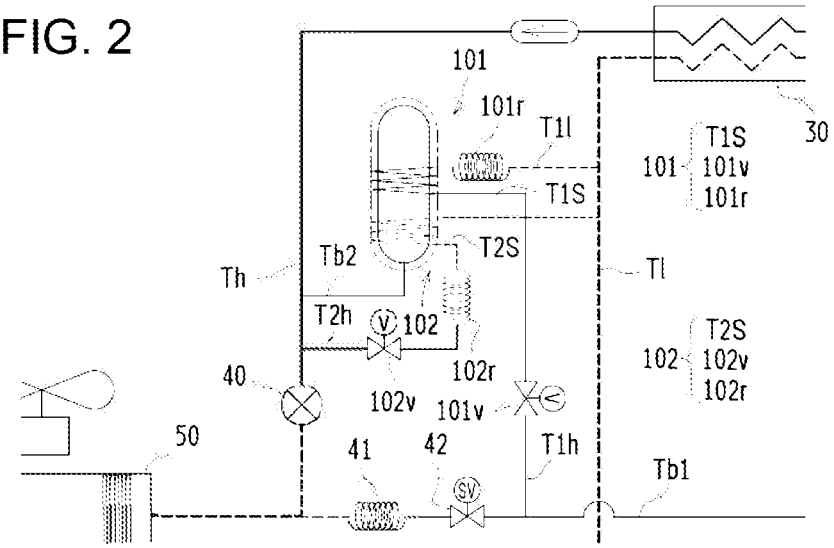

HEAT PUMP DEVICE

This application is a national stage filing of International Application No. PCT/JP2021/030887, filed Aug. 24, 2021. The entire disclosure of the afore-mentioned patent application is incorporated herein by reference.

TECHNICAL FIELD

The present technology relates to a heat pump device.

BACKGROUND

A heat pump device, for example, a heat pump water heater using carbon dioxide as a refrigerant, often operates in an environment in which operating conditions such as air temperature, water temperature and hot water supply demand are liable to fluctuate. Therefore, the pressure in the high-pressure space and the low-pressure space in the refrigerant circulating circuit is liable to fluctuate, and it is required to quickly and appropriately adjust the amount of the refrigerant circulating in the refrigerant circulating circuit in order to maintain the normal operation.

CITATION LIST

Patent Literature

Patent Document 1: Japanese Patent No. 3602116
Patent Document 2: Chinese Utility Model No. 209214113

The heat pump hot water supply device disclosed in Japanese Patent No. 3602116 is configured to heat a buffer tank by operating a heater attached to the buffer tank at a preset minimum temperature and maximum temperature to discharge refrigerant in the buffer tank.

The heat pump hot water supplying device disclosed in Chinese Utility Model No. 209214113 is configured to raise or lower the temperature of the refrigerant in the buffer tank by a refrigerant amount adjusting mechanism provided with not only a heating means but also a cooling means.

SUMMARY

Technical Problem

FIG. 5 shows a basic configuration of a refrigerant amount adjusting mechanism in a heat pump device, for example, a heat pump hot water supply device. As shown in FIG. 5, the refrigerant amount adjusting mechanism includes a buffer tank 21, a heating unit 221, and a cooling unit 222. The buffer tank 21 has a container body 211 for storing the carbon dioxide refrigerant, and the inside of the container body 211 communicates with a high-pressure side refrigerant pipe Th via the refrigerant branch pipe Tb2. The refrigerant heating circuit 221 includes a heating refrigerant pipe T1s, a first control valve 221*a*, and a refrigerant branch pipe Tb3. One end of the heating refrigerant pipe T1s is connected to the high-pressure refrigerant pipe Th on the high-pressure side Hs of the compressor 11 by the refrigerant branch pipe Tb3 through the first control valve 221*a*, and the other end is connected to the low-pressure cooling pipe TI on a low-pressure side Lb of the refrigerant expansion valve 14 by the refrigerant branch pipe Tb3. Only when the first control valve 221*a* is open, the high-temperature refrigerant from the high-pressure side Hs of the compressor 11 exchanges heat with the container body 211 via the heating refrigerant pipe T1s, and then flows to the low-pressure side Lb of the refrigerant expansion valve 14. On the other hand, the refrigerant cooling circuit 222 includes a cooling refrigerant pipe T2s, a second control valve 222*a*, and a refrigerant branch pipe Tb4. One end of the cooling refrigerant pipe T2s is connected to the low-pressure refrigerant pipe TI on the low-pressure side Lb of the refrigerant expansion valve 14 by the refrigerant branch pipe Tb4 through the second control valve 222*a*, and the other end is connected to the low-pressure refrigerant pipe TI on a downstream side of the evaporator 15 through the refrigerant branch pipe Tb4. Only when the second control valve 222*a* is open, the low-temperature refrigerant from the low-pressure side Lb of the refrigerant expansion valve 14 exchanges heat with the container body 211 through the cooling refrigerant pipe T2s, and then flows to the downstream side of the evaporator 15.

However, in the refrigerant amount adjusting mechanism shown in FIG. 5, when the high-temperature refrigerant introduced from the high-pressure side Hs of the compressor 11 is discharged through the first control valve 221, the pressure drops significantly, so that the temperature of the refrigerant flowing through the heating refrigerant pipe T1s drops significantly. Therefore, it is difficult to raise the temperature in the container body 211 in a short time. Further, since the low-temperature refrigerant flowing from the downstream side of the evaporator 15 through the second control valve to the cooling refrigerant pipe T2s directly flows to an upstream side of the refrigerant heat exchanger 13 after heat exchange with the container body 211, the pressure difference across the cooling refrigerant pipe T2s is small, and the flow rate of the refrigerant tends to be unstable. Therefore, it is difficult to reduce the temperature in the buffer tank in a short time. Further, the refrigerant branch pipe Tb3 on the downstream side of the heating refrigerant pipe T1s is connected between the refrigerant outlet of the expansion valve 14 and the refrigerant inlet of the evaporator 15, and this space is a space in which the refrigerant liquid and the saturated refrigerant gas exist in a mixed state, and the refrigerant flows into the evaporator 15 to be cooled by heat exchange with air, and when the high-temperature (for example, 50° C.) superheated gas discharged from the heating refrigerant pipe T1s enters, the cooling of the refrigerant is adversely affected.

A heat pump device having a buffer tank with a wider range of refrigerant temperature adjustment, higher adjustment accuracy, and faster heating/cooling control response is desired.

A heat pump device in which a buffer tank rapidly and appropriately discharge or collect refrigerant is desired.

A heat pump capable of efficiently adjusting the temperature in a buffer tank for collecting or discharging refrigerant in a high-pressure space of a refrigerant circulation circuit is desired.

Further, in the conventional heat pump water heater, in order to operate the heat pump water heater with optimum efficiency while keeping up with changes in temperature due to seasons, it is only necessary to adjust the optimum amount by heating and cooling the refrigerant present in the buffer tank. In other words, it was sufficient to follow the changes at most hourly, such as seasonal and daily temperature changes. However, in recent years, not only hot water storage operation (heating tap water and storing hot water in a hot water storage tank at 65-90° C.) but also circulation and heat storage operation for heating hot water in a heat storage tank for floor heating (the whole tank is nearly uniform and the set temperature is often set at 45-55° C.) have been frequently performed.

In such a case, two types of tanks, a hot water storage tank and a heat storage tank, are attached to one system, and when switching from the hot water storage operation to the heat storage operation or from the heat storage operation to the hot water storage operation, it is necessary to switch each tank and operate the heat pump device. In this case, it is necessary to reduce the amount of refrigerant by about 30% with respect to the amount of high-pressure refrigerant required for hot water storage operation (for example, heating tap water at 20° C. to 90° C. with a water heat exchanger) and the amount of refrigerant required for heat pump heating in circulation and heating operation (for example, 55→60° C.). For this purpose, it is necessary to lower the temperature of the buffer tank by about 30° C. to absorb the refrigerant. It is desirable to be able to adjust the temperature of the buffer tank in as short a time as possible so as to be able to cope with instantaneous operation switching.

If the lowering of the buffer temperature is delayed, the refrigerant which could not be absorbed is once discharged and accumulated in the accumulator, and it is necessary to prevent the refrigerant which exceeds the accumulated amount of the accumulator from flowing further into the compressor and coming into an operating state called refrigerant liquid compression. Therefore, it is desired to cool the buffer tank (for example, to control the temperature of the buffer surface from 30° C. to 10° C. or less) in units of seconds or minutes.

Solution to Problem

Disclosed is a heat pump device in which a compressor, a gas cooler, a refrigerant heat exchanger, a refrigerant expansion valve, and an evaporator are connected to configure a refrigerant circulation circuit, wherein the heat pump device includes a buffer tank, one end of which is connected to the high-pressure side of the refrigerant expansion valve and arranged to store a refrigerant, and a first refrigerant pipe, one end of which is connected to the high-pressure side of the compressor and the other end of which is connected to the downstream side of the evaporator and arranged to exchange heat with the buffer tank, wherein the first refrigerant pipe includes a first control valve arranged between the high-pressure side of the compressor and the buffer tank to control the opening and closing of the first refrigerant pipe, and a first flow rate regulator arranged between the buffer tank and the downstream side of the evaporator to control the flow rate of the refrigerant.

According to the present technology, for example, since the temperature in the buffer tank for collecting or discharging the refrigerant in the high-pressure space can be adjusted in a wide range in a short time, it is possible to quickly and appropriately adjust the amount of the refrigerant circulating in the refrigerant circulating circuit. That is, in the heating unit, since the refrigerant is introduced from the high-pressure side of the compressor through the first control valve and is discharged to the downstream side of the evaporator through the first resistance unit, the pressure on a refrigerant discharge side becomes low, and the pressure of the entire heating unit becomes high. Therefore, the high-temperature refrigerant can be introduced more stably. At the same time, since the first resistance unit is connected to the downstream side of the heating refrigerant pipe, the pressure on the upstream side of the heating refrigerant pipe rises, so that a drop in the pressure of the refrigerant discharged from the first control valve is suppressed, and a drop in the temperature of the refrigerant flowing through the heating refrigerant pipe is suppressed. Therefore, the temperature in the buffer tank can be rapidly increased. On the other hand, in the cooling unit, since the refrigerant is introduced from the high-pressure side of the refrigerant expansion valve via the second control valve and discharged to the downstream side of the evaporator, the pressure on a refrigerant introduction side (also referred to as the upstream side) increases and the pressure difference across the entire cooling section increases, so that the low-temperature refrigerant can be introduced more efficiently. At the same time, since the refrigerant after the temperature has dropped by flowing through the second resistance unit flows into the cooling refrigerant piping, it is possible to quickly cool the refrigerant in the buffer tank.

In this technology, for example, the high-pressure side of the compressor, the gas cooler, the high-pressure portion of the refrigerant heat exchanger, and the high-pressure side of the refrigerant expansion valve may be sequentially connected via a high-pressure refrigerant pipe which is a part of the refrigerant circulation path to configure a high-pressure space of the refrigerant circulation circuit. The low-pressure side of the refrigerant expansion valve, the evaporator, the low-pressure portion of the refrigerant heat exchanger, and the low-pressure side of the compressor may be sequentially connected via a low-pressure refrigerant pipe which is a part of the refrigerant circulation path to configure a low-pressure space of the refrigerant circulation circuit. An accumulator may be connected in a section from a discharge side of the evaporator to the introduction side of the compressor, and a refrigerant dividing circuit may be provided between the high-pressure side of the compressor and the low-pressure side of the refrigerant expansion valve. The buffer tank may be connected to the refrigerant branch pipe branched from the high-pressure refrigerant pipe, and the control unit may control the opening and closing of the first control valve and the second control valve based on operation information including the degree of superheat of the refrigerant introduced into the compressor.

According to the structure described above, for example, it is possible to construct a circulation circuit in which the proportion of the high-pressure space is small and which is safer and more efficient, and it is possible to more quickly and accurately adjust the amount of refrigerant circulated in the circulation circuit according to the temperature throughout the year. Further, since the controller controls the temperature adjusting unit based on the operation information including the degree of superheat of the refrigerant introduced into the compressor, the amount of the refrigerant circulating in the high-pressure space of the refrigerant circulating circuit can be quickly and appropriately adjusted according to the operation state. As a result, since the pressure in the high-pressure space and the superheat degree in the low-pressure space in the refrigerant circulation circuit are appropriately maintained, the safety, stability, and operating efficiency of the heat pump device can be improved.

In the heat pump device described above, for example, the heating refrigerant pipe and the cooling refrigerant pipe may be arranged on the outer wall of the buffer tank or in the container. According to this structure, for example, the temperature in the buffer tank can be easily adjusted by a simple structure.

In the heat pump device described above, for example, the first resistance unit may be a capillary tube. According to this configuration, the flow passage of the refrigerant after heat exchange with the buffer tank can be narrowed.

In the heat pump device, for example, the second resistance unit may be a capillary tube. According to this configuration, it is possible to narrow the flow passage being introduced into the cooling refrigerant pipe can be narrowed.

BRIEF DESCRIPTION OF DRAWINGS

FIG. 1 is a diagram showing a basic structure of a heat pump device according to an embodiment of the present technology.

FIG. 2 is a diagram showing a temperature adjusting unit for adjusting the temperature of the buffer tank in the heat pump device of FIG. 1.

DESCRIPTION OF EMBODIMENTS

Figure 3:
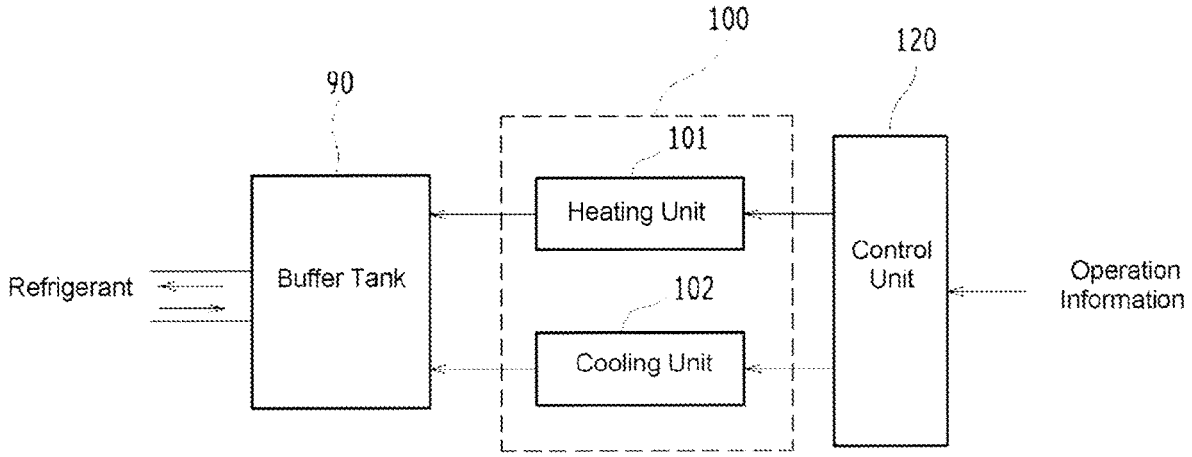
FIG. 3 is a block diagram showing the operation of the control unit for controlling the temperature control unit of FIG. 2.

FIG. 1 is a configuration diagram showing a basic structure of a heat pump device according to an embodiment of the present technology. As shown in FIG. 1, the heat pump device 1 of the present embodiment includes a compressor 10, a gas cooler 20, a refrigerant heat exchanger 30, a refrigerant expansion valve 40, and an evaporator 50. And the compressor 10, the gas cooler 20, the refrigerant heat exchanger 30, the refrigerant expansion valve 40, and the evaporator 50 are sequentially connected to configure a refrigerant circulation circuit. The refrigerant circulation circuit is filled with a refrigerant which is carbon dioxide. The refrigerant may be a chlorofluorocarbon (CFC) or a Hydrochlorofluorocarbon (HCFC), or may be a natural refrigerant such as methane or propane. The heat pump device 1 may be a hot water supply device, an air conditioner, a cooling device, a heating device, or a refrigerator. In the present embodiment, an example of a water heater will be described for convenience.

Specifically, the high-pressure side Hs of the compressor 10, the gas cooler 20, the high-pressure portion Ht of the refrigerant heat exchanger 30, and the high-pressure side Hb of the refrigerant expansion valve 40 are sequentially connected via a high-pressure refrigerant pipe Th (indicated by a bold line in FIG. 1) which is a part of the refrigerant circulation path to configure a high-pressure space (also referred to as a high-pressure circuit or a high-pressure piping system; hereinafter the same) of the refrigerant circulation circuit. The low-pressure side Lb of the refrigerant expansion valve 40, the evaporator 50, the low-pressure portion Lt of the refrigerant heat exchanger 30, and the low-pressure side Ls of the compressor 10 are sequentially connected via a low-pressure refrigerant pipe TI (shown by a broken line in FIG. 1) which is a part of the refrigerant circulation path, thereby forming a low-pressure space (also referred to as a low-pressure circuit or a low-pressure piping system; hereinafter the same) of the refrigerant circulation circuit. The compressor 10 compresses the refrigerant in a gaseous state introduced from the low-pressure side Ls and discharges the high-pressure high-temperature refrigerant from the high-pressure side Hs.

The gas cooler 20 is a counter-flow type heat exchanger of a double tube system, and heats water supplied by a water pump 21 or the like by heat exchange with high-pressure high-temperature refrigerant from a high-pressure refrigerant pipe Th, and discharge hot water.

The refrigerant heat exchanger 30 exchanges heat with the refrigerant in the low-pressure space after the refrigerant has exchanged heat with water in the gas cooler 20, and the high-pressure portion Ht thereof is connected to the high-pressure refrigerant pipe Th, and the low-pressure portion Lt thereof is connected to the low-pressure refrigerant pipe TI. A strainer 32 serving as a filter is provided downstream of the high-pressure portion Ht of the refrigerant heat exchanger 30.

The refrigerant expansion valve 40 expands the high-pressure medium-to-low-temperature refrigerant introduced from the high-pressure side Hb, and discharges the refrigerant having a reduced pressure from the low-pressure side Lb.

The evaporator 50 is, for example, an air heat exchanger equipped with a fan 51, such as the heat source machine CHP-80Y2 of Nihon Itomic Co., Ltd., and is configured to evaporate and discharge the refrigerant by performing heat exchange between the outside air introduced by the fan 51 and the refrigerant from the refrigerant expansion valve 40. The discharge side of the evaporator 50 is connected to the low-pressure portion Lt of the refrigerant heat exchanger 30 via the low-pressure refrigerant pipe TI, and the refrigerant discharged from the evaporator 50 exchanges heat with the refrigerant flowing in the high-pressure portion Ht of the refrigerant heat exchanger 30 to be further evaporated.

An accumulator 31 is connected between the downstream side of the low-pressure portion Lt of the refrigerant heat exchanger 30 and the low-pressure side Ls of the compressor 10 via a low-pressure refrigerant pipe TI. The accumulator 31 is a protective device provided to prevent the refrigerant from being sucked into the compressor 10 as a liquid when the refrigerant from the evaporator 50 is not sufficiently evaporated and cannot be sufficiently dried even if heated by the refrigerant heat exchanger 30.

A refrigerant flow dividing control valve 42 and a flow rate regulator 41 are provided between the high-pressure side Hs of the compressor 10 and the low-pressure side Lb of the refrigerant expansion valve 40. The flow regulator 41 may be a capillary tube. The refrigerant flow dividing control valve 42 and the flow rate regulator 41 configure a refrigerant flow dividing circuit together with the refrigerant flow dividing pipe Tb1, and the refrigerant in the high-pressure space is divided into the low-pressure space through the refrigerant flow dividing circuit. In this refrigerant flow dividing circuit, as a defrosting circuit, the refrigerant flow dividing control valve 42 opens only when frost adheres to the evaporator 50, and high-temperature refrigerant from the high-pressure space is sent to the evaporator 50 to melt the frost.

Since the refrigerant circulation circuit of the heat pump device 1 is a closed loop, the amount of refrigerant to be filled is constant and does not change. However, since the evaporation temperature of the air heat exchanger in the evaporator 50 changes according to air temperature, the density of the refrigerant amount in the low-pressure space changes according to the air temperature. Therefore, the distribution of the amount of refrigerant in the high-pressure space and the low-pressure space changes greatly depending on the air temperature. At high air temperatures (e.g., in summer), the refrigerant tends to evaporate, increasing the density of the refrigerant circulating in the low-pressure space. That is, the amount of refrigerant in the low-pressure space increases and the amount of refrigerant in the high-pressure space decreases. In general, when the amount of refrigerant circulating in the high-pressure space becomes insufficient, it is conceivable that the coefficient of performance (COP) decreases and the compressor is damaged. On the other hand, the refrigerant circulating circuit may be filled with a large amount of refrigerant so that normal operation can be maintained even at high air temperatures. However, when the amount of the refrigerant circulating in the refrigerant circulating circuit is too large, the refrigerant is difficult to evaporate at low air temperature (for example, in winter), so that the amount of the refrigerant circulating in the low-pressure space decreases, the amount of the refrigerant circulating in the high-pressure space increases, and the pressure in the high-pressure space increases. In general, when the pressure in the high-pressure space rises more than necessary, the high-pressure switch operates and stops operation, or the coefficient of performance (COP) decreases. Accordingly, it is necessary to appropriately adjust the amount of refrigerant circulating in the refrigerant circulating circuit, particularly in the high-pressure space, according to the air temperature.

On the other hand, in the present embodiment, a buffer tank 90 for adjusting the amount of refrigerant circulating in the refrigerant circulation path is provided in the high-pressure side Hb of the refrigerant expansion valve 40. The buffer tank 90 is a container for storing a carbon dioxide refrigerant, and its outer wall is entirely covered with a heat insulating material, making it difficult for the refrigerant inside to exchange heat with outside air. The inside of the buffer tank 90 is connected to the refrigerant branch pipe Tb2 branched from the high-pressure refrigerant pipe Th, and communicates with the high-pressure refrigerant pipe Th via the refrigerant branch pipe Tb2. Therefore, the buffer tank 90 can collect the refrigerant from the high-pressure refrigerant pipe Th or discharge the refrigerant to the high-pressure refrigerant pipe Th via the refrigerant branch pipe Tb2. Further, the refrigerant branch pipe Tb2 branched from the high-pressure refrigerant pipe Th may not have a control valve or control means, so that the refrigerant is allowed to enter and exit freely. In this case, there is an advantage that the control of the buffer tank is simplified only by the surface temperature.

In order to collect or discharge the refrigerant by the buffer tank 90, a temperature adjusting unit 100 (see FIG. 3) for adjusting the temperature in the buffer tank 90 and a control unit 120 (see FIG. 3) for controlling the temperature adjusting unit 100 according to the operating condition are provided. FIG. 2 is a configuration diagram showing the configuration of the temperature adjusting unit 100 for adjusting the temperature in the buffer tank 90. As shown in FIGS. 2 and 3, the temperature adjusting unit 100 includes a heating unit 101 for increasing the temperature in the buffer tank 90 and a cooling unit 102 for decreasing the temperature in the buffer tank 90.

The heating unit 101 includes a heating refrigerant pipe T1s for heating the temperature in the buffer tank 90, a first control valve 101*v* connected to the upstream end of the heating refrigerant pipe T1s and controlling the opening and closing of the heating refrigerant pipe T1s, and a first resistance unit 101*r* connected to the downstream end of the heating refrigerant pipe T1s.

The heating refrigerant pipe T1s is arranged to coil around the buffer tank 90 between the heat insulating material and the outer wall of the buffer tank 90, and increases the temperature in the buffer tank 90 by exchanging heat with the outer wall of the buffer tank 90. The heating refrigerant pipe T1s has an upstream end connected to the refrigerant flow dividing pipe T1h branched from the refrigerant flow dividing pipe Tb1 via the first control valve 101*v* to introduce a high-temperature refrigerant from the high-pressure side Hs of the compressor 10, and a downstream end connected to the refrigerant flow dividing pipe T1l branched from the low-pressure cooling pipe TI on the downstream side of the evaporator 50 via the first resistance unit 101*r* to discharge the refrigerant after heat exchange with the buffer tank 90 to the downstream side of the evaporator 50.

The first resistance portion 101*r* may be a flow rate regulator capable of limiting the flow rate of the refrigerant, or may be a capillary tube having a narrow flow passage of the refrigerant. Since the first resistance unit 101*r* is connected to the downstream end of the heating refrigerant pipe T1s, the pressure at the upstream end of the heating refrigerant pipe T1s increases. Therefore, it is possible to prevent the pressure of the refrigerant discharged from the first control valve 101*v* from decreasing and the temperature of the refrigerant flowing through the heating refrigerant pipe T1s from greatly decreasing.

The cooling section 102 includes a cooling refrigerant pipe T2s for lowering the temperature in the buffer tank 90, a second control valve 102*v* for controlling the opening and closing of the cooling refrigerant pipe T2s, and a second resistance unit 102*r* connected to the upstream end of the cooling refrigerant pipe T2s.

The cooling refrigerant pipe T2s is arranged to coil around the buffer tank 90 between the heat insulating material and the outer wall of the buffer tank 90, and lowers the temperature in the buffer tank 90 by heat exchange with the outer wall of the buffer tank 90. The cooling refrigerant pipe T2s has an upstream end connected to a second control valve 102*v* via a second resistance unit 102*r*, and further connected to a refrigerant branch pipe T2h branched from a high-pressure refrigerant pipe Th in a high-pressure side Hb of a refrigerant expansion valve 40 via the second control valve 102*v* to introduce a refrigerant, and a downstream end connected to a low-pressure cooling pipe TI on the downstream side of an evaporator 50 to discharge the refrigerant after heat exchange with a buffer tank 90 to the downstream side of the evaporator 50.

The second resistance unit 102*r* may be a flow rate regulator capable of limiting the flow rate of the refrigerant, or may be a capillary tube having a narrow flow passage of the refrigerant. Since the second resistance unit 102*r* is connected to the upstream end of the heating refrigerant pipe T2s, the refrigerant from the high-pressure refrigerant pipe Th on the high-pressure side Hb of the refrigerant expansion valve 40 first flows through the second resistance unit 102*r* to lower the temperature before flowing through the cooling refrigerant pipe T2s, thereby increasing the cooling effect.

FIG. 3 is a block diagram showing the operation of the control unit 120 for controlling the temperature adjusting unit 100 described above. As shown in FIG. 3, the control unit 120 is connected to the heating unit 101 (first control valve 101*v*) and the cooling unit 102 (second control valve 102*v*), respectively. The control unit 120 determines whether or not the amount of refrigerant circulating in the high-pressure space is insufficient on the basis of a state variable capable of reflecting the operating state, and if it is determined that the amount of refrigerant is insufficient, controls so that the buffer tank 90 is heated by operating the heating unit 101 (opening the first control valve 101*v*) and the refrigerant is discharged from the buffer tank 90 to the high-pressure side Hb of the refrigerant expansion valve 40, while if it is determined that the amount of refrigerant is excessive, controls so that the buffer tank 90 is cooled by operating the cooling unit 102 (opening the second control valve 102*v*) and the refrigerant is recovered from the high-pressure side Hb of the refrigerant expansion valve 40 into the buffer tank 90.

Here, the first control valve 101*v* may be a solenoid valve and is opened and closed based on a control signal from the control unit 120. When the first control valve 101*v* is open, the high-temperature refrigerant from the high-pressure side Hs of the compressor 10 is introduced into the heating refrigerant pipe T1s and undergoes heat exchange with the buffer tank 90 before being discharged to the downstream side of the evaporator 50. When the first control valve 101*v* is closed, the refrigerant on the high-pressure side Hs of the compressor 10 is cut off.

Similarly, the second control valve 102*v* may be a solenoid valve and is opened and closed based on a control signal from the control unit 120. When the second control valve 102*v* is open, the refrigerant from the high-pressure side Hb of the refrigerant expansion valve 40 flows through the second resistor 102*r* into the cooling refrigerant pipe T2s after the pressure and temperature drop, and is discharged to the downstream side of the evaporator 50 after heat exchange with the buffer tank 90. When the second control valve 102*v* is closed, the refrigerant on the high-pressure side Hb of the refrigerant expansion valve 40 is cut off.

In this embodiment, the control unit 120 for controlling the heating unit 101 and the cooling unit 102 calculates the superheat degree SH of the refrigerant introduced into the compressor 10 based on the evaporation temperature tj of the air heat exchanger in the evaporator 50 and the refrigerant introduction temperature ti on the introduction side of the compressor 10, and determines whether or not the amount of the refrigerant circulating in the high-pressure space is appropriate based on the calculated superheat degree SH.

Specifically, the superheat degree SH is calculated by the difference between the refrigerant introduction temperature ti at the introduction side of the compressor 10 and the evaporation temperature tj of the air heat exchanger, that is, SH=ti−tj. If the superheat degree SH is within the target range (SHl to SHh, for example, 5 to 15 deg° C.), it is determined that the amount of refrigerant circulating in the refrigerant circulating circuit is appropriate. When the air temperature decreases, the superheat SH decreases, and when the superheat SH becomes equal to or less than the lower limit value SHl, it indicates that the refrigerant is not sufficiently dried in the evaporator and the amount of refrigerant circulating in the high-pressure space becomes excessive. If such a situation continues, in general, there is a risk of a decrease in operating efficiency, damage to the compressor, deterioration, and the like. Conversely, when the temperature rises, the superheat SH rises, and when the superheat SH becomes equal to or greater than the upper limit value SHh, this indicates that the temperature of the refrigerant in the low-pressure space is too high and the circulating refrigerant is insufficient. If such a situation continues, it is generally considered that a decrease in coefficient of performance (COP) occurs. Therefore, the degree of superheat SH is one of the state variables reflecting the operating conditions such as air temperature. Based on this principle, the control unit 120 controls the temperature adjustment unit 100 by using the degree of superheat SH of the refrigerant introduced into the compressor 10 as information reflecting the operating condition.

Figure 4:
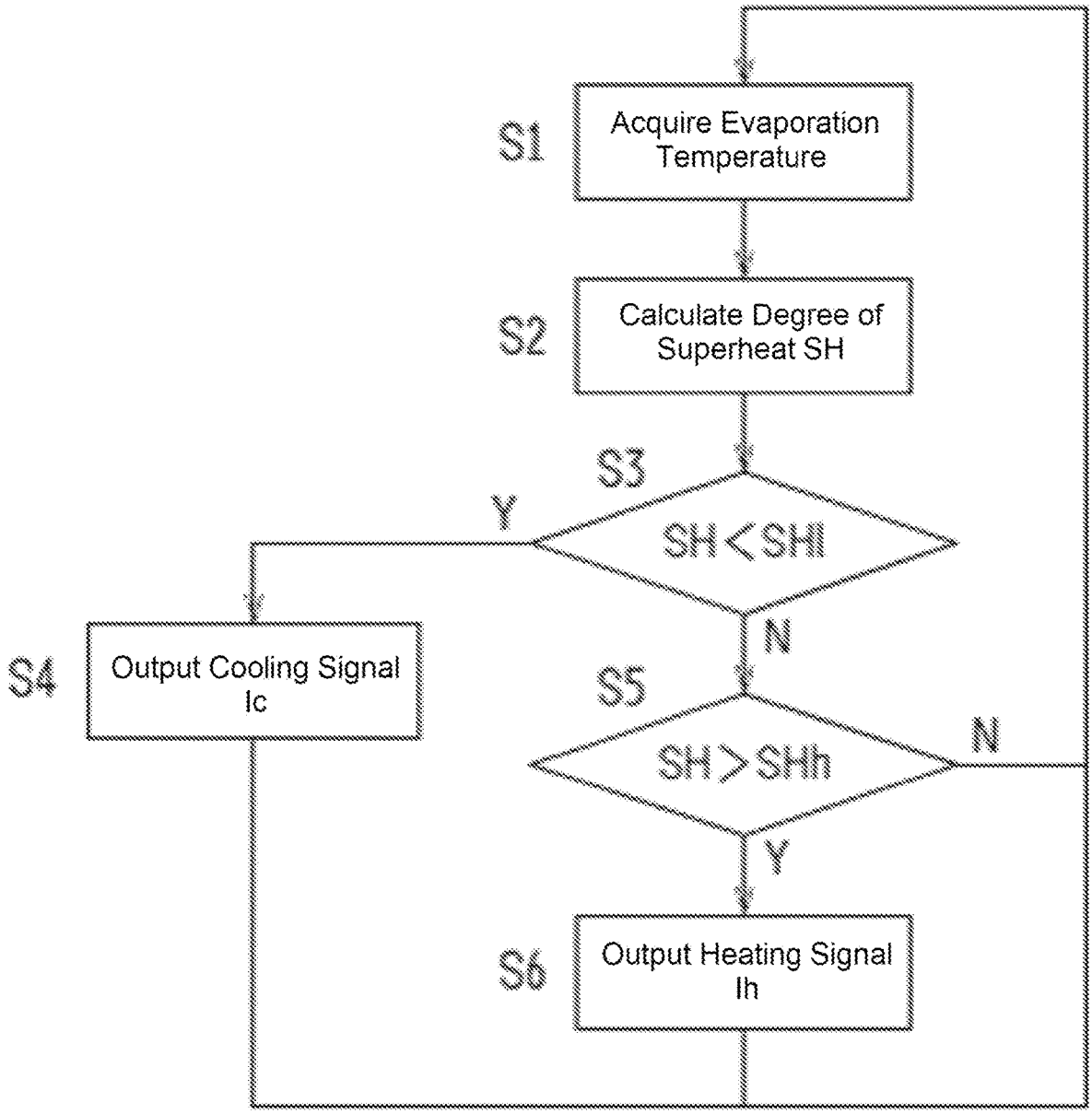
FIG. 4 is a flowchart for explaining control performed by the control unit of FIG. 3.
Figure 5:
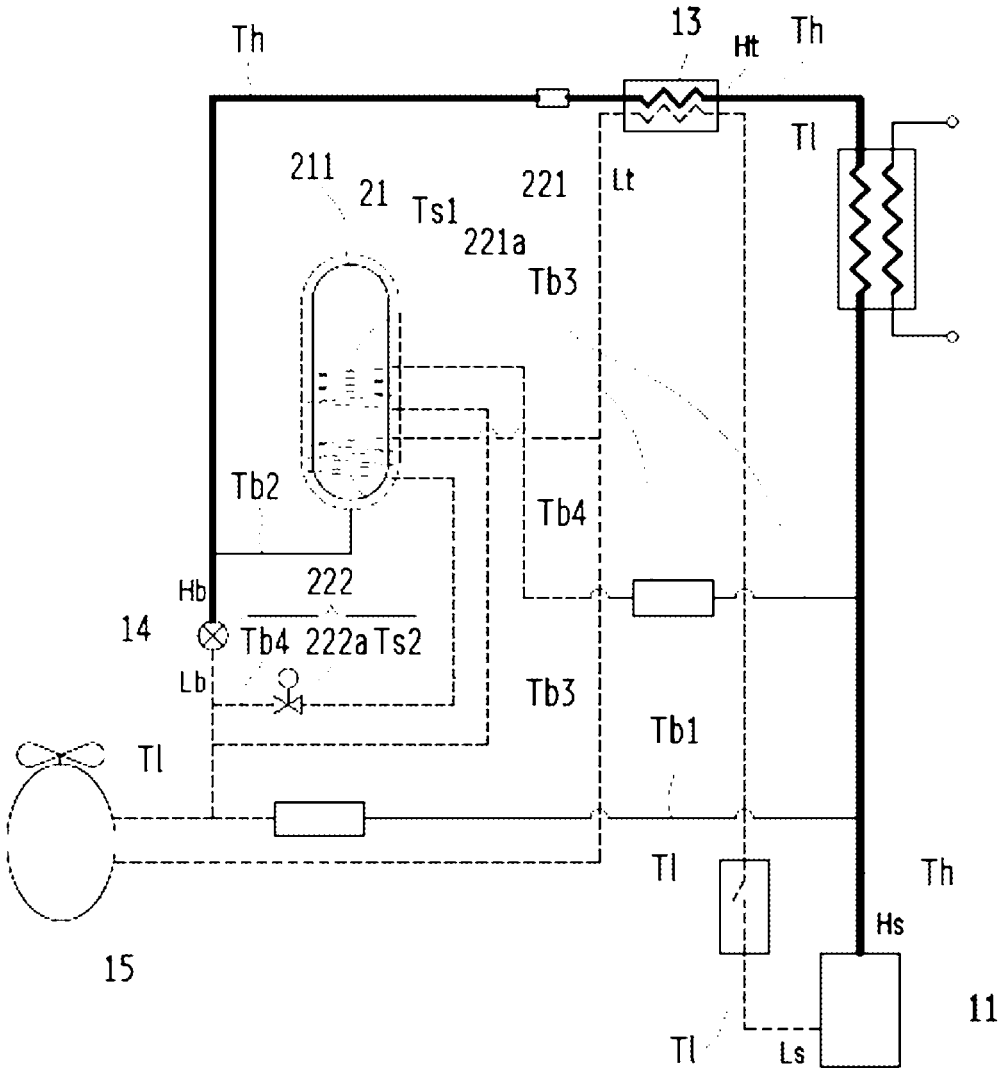
FIG. 5 is a diagram showing a basic structure of a heat pump device.

FIG. 4 is a flowchart for explaining the control performed by the control unit 120. As shown in FIG. 4, the control unit 120 acquires the evaporation temperature tj of the air heat exchanger of the evaporator 50 and the refrigerant introduction temperature ti on the introduction side of the compressor 10 via, for example, a temperature sensor (step S1), calculates the degree of superheat SH (SH=ti−tj) of the refrigerant introduced into the compressor 10 (step S2), determines whether the calculated degree of superheat SH is smaller than the lower limit value SHl of the normal range (step S3), outputs the cooling signal Ic to the second control valve 102*v* when the degree of superheat SH is smaller than the lower limit value SHl (SH<SHl) (Y) (step S4), returns to step S1, and conversely, when the degree of superheat SH is not less than the lower limit value SHl of the normal range (not SH<SHl) (N), determines whether the superheat SH is larger than the upper limit value SHh of the normal range (step S5), outputs the heating signal Ih to the first control valve 101*v* (step S6), returns to step S1, and conversely, when the degree of superheat SH is not greater than the upper limit value SHh of the normal range (not SH>SHh) (N), returns to step S1 and repeats the above described steps.

In a heating unit 101, the first control valve 101*v* keeps an open state for a long time while receiving a control signal Ih from a control unit 120, a high-temperature refrigerant flows into a heating refrigerant pipe T1s from a high-pressure refrigerant pipe Th on the high-pressure side Hs of a compressor 10 to heat the buffer tank 90, and when the control signal Ih from the control unit 120 is interrupted, the first control valve 101*v* closes, high-temperature refrigerant on the high-pressure side Hs of the compressor 10 is cut off, and heating of the buffer tank 90 is stopped.

When the buffer tank 90 is heated by the heating refrigerant pipe T1s, the pressure increases as the temperature inside the buffer tank 90 increases, so that the refrigerant is discharged to the high-pressure refrigerant pipe Th through the refrigerant branch pipe Tb2.

In the cooling unit 102, while the second control valve 102*v* receives the control signal Ic from the control unit 120, the second control valve 102*v* is kept open, the refrigerant from the high-pressure refrigerant pipe Th in the high-pressure side Hb of the refrigerant expansion valve 40 reaches a low temperature via the second resistance 102*r*, and then flows into the cooling refrigerant pipe T2s to cool the buffer tank 90, and when the control signal Ic from the control unit 120 is interrupted, the second control valve Th is closed, and the refrigerant from the high-pressure side Hb of the refrigerant expansion valve 40 is cut off, thereby stopping the cooling of the buffer tank 90.

When the buffer tank 90 is cooled by the cooling refrigerant pipe T2s, the pressure of the buffer tank 90 decreases as the temperature inside the buffer tank 90 decreases, thereby the refrigerant is sucked from the high-pressure refrigerant pipe Th on the high-pressure side Hb of the refrigerant expansion valve 40.

In this manner, the buffer tank 90 appropriately maintains the amount of refrigerant circulating in the refrigerant circulation circuit, particularly in the high-pressure space, by discharging the refrigerant into the refrigerant circulation path or collecting the refrigerant from the refrigerant circulation path in the high-pressure space in accordance with the operating conditions.

In this embodiment, as described above, since the heating unit 101 introduces the high-temperature refrigerant from the high-pressure side Hs of the compressor 10 via the first control valve 101*v* and discharges the refrigerant after the heat exchange to the downstream side of the evaporator 50, the pressure difference between the refrigerant introduction side and the refrigerant discharge side of the heating unit 101 increases, so that the high-temperature refrigerant can be introduced more efficiently. Further, since the first resistance unit 101*r*, in which the flow passage of the refrigerant is narrowed, is connected to the downstream side of the heating refrigerant pipe T1s, the pressure at the upstream end of the heating refrigerant pipe T1s is increased, so that a decrease in the pressure of the refrigerant discharged from the first control valve 101*v* is suppressed, and a significant decrease in the temperature of the refrigerant flowing in the heating refrigerant pipe T1s can be avoided. As a result, the buffer tank 90 can be heated to a predetermined temperature in a short time. On the other hand, since the cooling unit 102 introduces the refrigerant from the high-pressure side Hb of the refrigerant expansion valve 40 via the second control valve 102*v* and discharges the refrigerant after the heat exchange to the downstream side of the evaporator 50, the pressure difference between the refrigerant introduction side and the refrigerant discharge side of the cooling unit 102 increases, so that the low-temperature refrigerant can be introduced more efficiently. In addition, since the second resistance unit having a narrow flow passage for the refrigerant is connected to the upstream end of the cooling refrigerant pipe T2s, the refrigerant first flows through the second resistance unit and then flows into the cooling refrigerant pipe T2s after the temperature of the second resistance unit decreases. Therefore, the low-temperature refrigerant can be introduced into the cooling refrigerant pipe T2s. Therefore, the buffer tank 90 can be cooled to a predetermined temperature in a short time.

Therefore, according to the heat pump device 1 of the present embodiment, since the temperature of the buffer tank 90 for collecting or discharging the refrigerant in the high-pressure space can be raised or lowered in a short time according to the operating condition, the amount of the refrigerant circulating in the refrigerant circulating circuit can be quickly and accurately adjusted. As a result, the operational stability, safety and operational efficiency of the heat pump device 1 can be improved.

The present technique is not limited to the above-described embodiment, and may be appropriately modified.

For example, in the above-described embodiment, the control unit 120 sets the degree of superheat SH of the refrigerant introduced into the compressor 10 as information reflecting the operating condition, and controls the temperature adjusting unit 100 based on the degree of superheat SH. However, the present technology is not limited to this, and the control unit 120 may control the temperature adjusting unit 100 based on other information (for example, the temperature and pressure of the refrigerant) which can reflect the operating state.

Further, in the above-described embodiment, the heating refrigerant pipe T1s and the cooling refrigerant pipe T2s are respectively arranged between the heat insulating material covering the outer wall of the buffer tank 90 and the outer wall of the buffer tank 90, but the present technology is not limited thereto, and the heating refrigerant pipe T1s and/or the cooling refrigerant pipe T2s may be arranged inside the buffer tank 90.

The present invention may be practiced in a variety of other ways without departing from its spirit or main features. Accordingly, the foregoing embodiments are merely illustrative in all respects and should not be construed as limiting. The scope of the invention is indicated by the claims and is not bound by the text of the specification. Further, all variations and modifications falling within the scope of the appended claims are within the scope of the present invention.

INDUSTRIAL APPLICABILITY

Provided is a heat pump device capable of efficiently adjusting the temperature in a buffer tank for collecting or discharging a refrigerant in a high-pressure space of a refrigerant circulation circuit, for example.

REFERENCE SIGNS LIST

1 Heat Pump Device
10 Compressor
20 Gas Cooler
30 Refrigerant Heat Exchanger
40 Refrigerant Expansion Valve
50 Evaporator

The invention claimed is:

1. A heat pump device in which a compressor, a gas cooler, a refrigerant heat exchanger, a refrigerant expansion valve, and an evaporator are connected to configure a refrigerant circulation circuit, the heat pump device comprising:

a buffer tank, one end of which is connected to a high-pressure side of the refrigerant expansion valve and arranged to store a refrigerant; and a first refrigerant pipe, one end of which is connected to the high-pressure side of the compressor and the other end of which is connected to a downstream side of the evaporator and arranged to exchange heat with the buffer tank;

wherein the first refrigerant pipe comprises:

a first control valve arranged between the high-pressure side of the compressor and the buffer tank to control the opening and closing of the first refrigerant pipe; and a first flow rate regulator arranged between the buffer tank and a downstream side of the evaporator to control the flow rate of the refrigerant.

2. The heat pump device according to claim 1, further comprising a second refrigerant pipe, one end of which is connected to the high-pressure side of the refrigerant expansion valve and the other end of which is connected to the downstream side of the evaporator, wherein the second refrigerant pipe comprises:

a second control valve arranged between the high-pressure side of the refrigerant expansion valve and the buffer tank to control opening and closing of the second refrigerant pipe; and a second flow rate regulator arranged between the high-pressure side of the refrigerant expansion valve and the buffer tank to control flow rate of the refrigerant.

3. The heat pump device according to claim 1, wherein the heat pump device is a hot water supply device, an air conditioner, a cooling device, a heating device, or a refrigerator.

4. The heat pump device of claim 1, wherein the buffer tank is configured to discharge refrigerant into or collect refrigerant from the refrigerant circulation path.

5. The heat pump device according to claim 1, wherein the first refrigerant pipe is configured to introduce the refrigerant from the high-pressure side of the compressor to heat the buffer tank by heat exchange, and to discharge the refrigerant after heat exchange with the buffer tank to the downstream side of the evaporator.

6. The heat pump device according to claim 2, wherein the second refrigerant pipe is configured to introduce the refrigerant from the high-pressure side of the refrigerant expansion valve to cool the buffer tank by heat exchange, and to discharge the refrigerant after heat exchange with the buffer tank to the downstream side of the evaporator.

7. The heat pump device of claim 1, wherein the first flow rate regulator is configured to limit a flow rate of refrigerant.

8. The heat pump device of claim 7, wherein the first flow rate regulator comprises a capillary tube.

9. The heat pump device of claim 1, wherein at least a portion of the first refrigerant pipe is arranged on or within an outer wall of the buffer tank.

10. The heat pump device according to claim 1, further configured to control opening and closing of the first control valve based on operation information including a degree of superheat of the refrigerant introduced into the compressor.

11. The heat pump device according to claim 1, wherein the refrigerant includes at least one of carbon dioxide, methane, propane, CFC, and HCFC.

12. The heat pump device according to claim 1, wherein the compressor, the gas cooler, the refrigerant heat exchanger, and the refrigerant expansion valve are sequentially connected to configure a high-pressure space of the refrigerant circulation circuit; and the refrigerant expansion valve, the evaporator, the refrigerant heat exchanger, and the compressor are sequentially connected to configure a low-pressure space of the refrigerant circulation circuit.

13. The heat pump device of claim 1, wherein the gas cooler is configured to heat water supplied via a heat exchanger.

14. The heat pump device according to claim 1, wherein the refrigerant heat exchanger is configured to exchange heat with the refrigerant in the low-pressure space after exchanging heat with the gas cooler.

15. The heat pump device of claim 1, further comprising an accumulator between the refrigerant heat exchanger and the compressor.

16. The heat pump device of claim 1, wherein the buffer tank is configured to collect refrigerant from or discharge refrigerant to the refrigerant circuit.

17. The heat pump device according to claim 1, wherein the first control valve is a solenoid valve.

18. The heat pump device according to claim 1, wherein the first control valve is opened when a difference between a refrigerant introduction temperature at an introduction side of the compressor and an evaporation temperature of the evaporator is larger than a predetermined value.

19. The heat pump device according to claim 2, wherein the second control valve is opened when a difference between a refrigerant introduction temperature at an introduction side of the compressor and an evaporation temperature of the evaporator is smaller than a predetermined value.

20. A method for controlling a heat pump in which a compressor, a gas cooler, a refrigerant heat exchanger, a refrigerant expansion valve, and an evaporator are connected to configure a refrigerant circulation circuit, the heat pump having a buffer tank, one end of which is connected to the high-pressure side of the refrigerant expansion valve and arranged to store a refrigerant, and a first refrigerant pipe, one end of which is connected to the high-pressure side of the compressor and the other end of which is connected to the downstream side of the evaporator and arranged to exchange heat with the buffer tank, and a second refrigerant pipe in which one end is connected to the high-pressure side of the refrigerant expansion valve and the other end is connected to the downstream side of the evaporator and arranged to exchange heat with the buffer tank, wherein the first refrigerant pipe includes a first control valve arranged between the high-pressure side of the compressor and the buffer tank to control the opening and closing of the first refrigerant pipe, and the second refrigerant pipe includes a second control valve arranged between the high-pressure side of the refrigerant expansion valve and the buffer tank to control opening and closing of the second refrigerant, the method comprising:

opening the second control valve in response to the difference between the refrigerant introduction temperature on the introduction side of the compressor and the evaporation temperature on the evaporators being smaller than a predetermined value; and opening the first control valve in response to the difference between the refrigerant introduction temperature on the introduction side of the compressor and the evaporation temperature on the evaporator being larger than a predetermined value.

* * * * *